US008616476B2

(12) United States Patent
Boltersdorf

(10) Patent No.: US 8,616,476 B2
(45) Date of Patent: Dec. 31, 2013

(54) PULPER COMPRISING A SCREENING SHEET

(71) Applicant: Hans-Joachim Boltersdorf, Brohl-Luetzing (DE)

(72) Inventor: Hans-Joachim Boltersdorf, Brohl-Luetzing (DE)

( * ) Notice: Subject to any disclaimer, the term of this patent is extended or adjusted under 35 U.S.C. 154(b) by 0 days.

(21) Appl. No.: 13/795,135

(22) Filed: Mar. 12, 2013

(65) Prior Publication Data

US 2013/0206881 A1 Aug. 15, 2013

Related U.S. Application Data

(63) Continuation of application No. PCT/DE2011/001644, filed on Aug. 26, 2011.

(30) Foreign Application Priority Data

| | | |
|---|---|---|
| Sep. 17, 2010 | (DE) | 10 2010 045 623 |
| Sep. 27, 2010 | (DE) | 10 2010 046 555 |
| Jun. 27, 2011 | (DE) | 10 2011 106 266 |

(51) Int. Cl.

| | |
|---|---|
| ***B02C 17/16*** | (2006.01) |
| ***B02C 23/16*** | (2006.01) |
| ***B02C 23/36*** | (2006.01) |

(52) U.S. Cl.
USPC ..... 241/46.17; 241/74; 241/172

(58) Field of Classification Search
USPC ..... 241/73, 74, 46.17, 172
See application file for complete search history.

(56) References Cited

U.S. PATENT DOCUMENTS

2007/0114311 A1 5/2007 Fukudome

FOREIGN PATENT DOCUMENTS

| | | |
|---|---|---|
| CA | 2 777 333 | 4/2011 |
| DE | 1 185 467 | 1/1965 |
| DE | 11 85 467 | 1/1965 |
| DE | 10 2009 009 405 | 3/2010 |
| WO | WO 2011/045094 | 4/2011 |

OTHER PUBLICATIONS

International Search Report of PCT/DE2011/001644, May 29, 2012.

*Primary Examiner* — Mark Rosenbaum
(74) *Attorney, Agent, or Firm* — Collard & Roe, P.C.

(57) ABSTRACT

An individual pulper is used and fibrous material is removed from the pulper in an optimum manner. In order to do this, the screening sheet of a pulper has openings which are disposed in various regions and have different sizes. The regions are concentric to each other.

12 Claims, 3 Drawing Sheets

PULPER COMPRISING A SCREENING SHEET

CROSS REFERENCE TO RELATED APPLICATIONS

Figure 1:
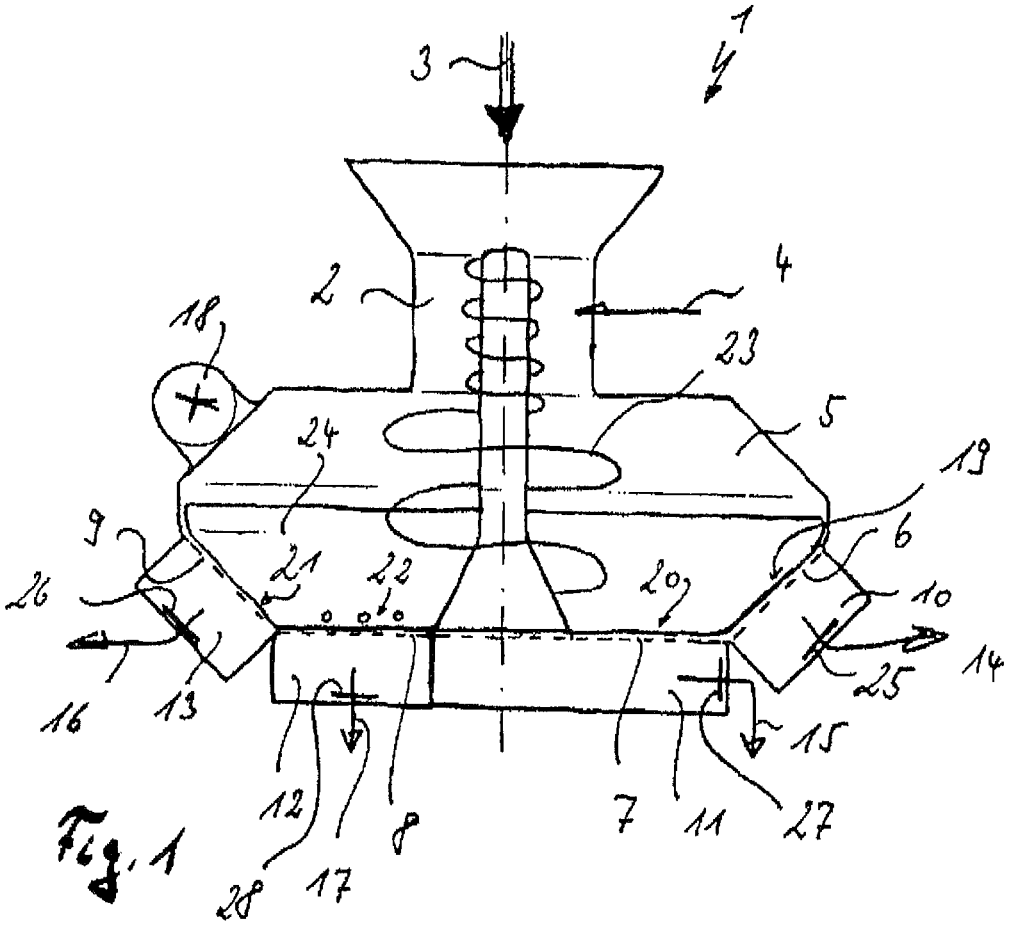

Applicant claims priority under 35 U.S.C. §119 of German Application No. 10 2010 045 623.3 filed on Sep. 17, 2010, German Application No. 10 2010 046 555.0 filed on Sep. 27, 2010, and German Application No. 10 2011 106 266.5 filed on Jun. 27, 2011. This application is also a continuation of and Applicant claims priority under 35 U.S.C. §120 of International Application No. PCT/DE2011/001644 filed on Aug. 26, 2011, which claims priority under 35 U.S.C. 119 of German Application No. 10 2010 045 623.3 filed on Sep. 17, 2010, German Application No. 10 2010 046 555.0 filed on Sep. 27, 2010, and German Application No. 10 2011 106 266.5 filed on Jun. 27, 2011. The international application under PCT article 21(2) was not published in English. The disclosure of the aforesaid International Application and German applications are incorporated by reference.

The invention relates to a pulper comprising a screen, wherein the screen in various regions comprises openings with different opening sizes. Pulpers are used to fiberise or pulp various materials, for example waste paper, labels or plant materials. Depending on the type of pulper, said pulper comprises a pot-shaped or pear-shaped vessel in which helical screws are used for conveyance and circulation.

DE 11 85 467 B describes a generic pulper in which a first chamber by means of openings communicates with a displacement chamber. A further chamber can be reached by means of openings from the first chamber. Consequently the sieves are connected in series in order to sieve the product so that it is increasingly finer.

Such pulpers are associated with a problem in that, depending on the material to be processed, depending on the ratio of water to solids, and depending on the manner of processing, different hole shapes and hole sizes in the screening sheet are advantageous. For this reason it is necessary either to attune the way of processing on the pulper, or to provide different screening sheets.

The object of the invention is met by a generic pulper in which the openings form a connection between a displacement chamber (5) and chambers (10, 13) and the regions by way of the openings communicate with various chambers, wherein the chambers in each case comprise at least one closable outlet.

The sieve regions are thus connected in parallel, while in contrast to this in the embodiment of DE 11 85 467 B a series connection is present. It has thus been possible to improve the separation efficiency.

In this context the term "opening size" refers to both the clear through-flow area and the hole shape. The openings can, for example, be round holes or slots. Furthermore, a distinction is made between different hole diameters, slot widths and slot lengths. Moreover, it is also possible to provide various hole geometries in that the edges of the holes have various shapes.

The term "various regions" refers to surfaces comprising several openings, preferably more than ten openings. Each region comprises either one or several screening sheet parts, and the regions are preferably delimited by edges or kinks or supporting surfaces of the screening sheet.

This makes it possible to remove different materials fractions from a pulper. For example, it is possible in various regions to provide slots that are 0.1 mm wide and mm long for fibres; round holes that are 1 mm in diameter for attendant materials; and round holes that are 3 mm to 6 mm in diameter for grinding elements such as balls.

In this arrangement a screening sheet can comprise regions with various openings of different sizes. It is advantageous if the screening sheet comprises multiple parts in order to in each case in a screening sheet part provide only one opening size.

The regions of the screening sheet can be arranged in various ways in the pulper. In this arrangement the bottom region can be arranged so as to be horizontal in the known way. It is advantageous if a transition region is arranged so as to be inclined. A further enlargement of the region designed as a screening sheet results when an edge region is arranged so as to be perpendicular.

It is advantageous if the regions are arranged so as to be concentric relative to each other. In this arrangement a perpendicular edge region can follow on from the bottom region, or an inclined transition region is provided between the bottom region and the edge region.

A special embodiment provides for the screening sheet to be designed as a cage. Such a cage can be made from screening sheet parts that are arranged so as to be adjacent to each other, or it can comprise a curved or kinked screening sheet surface.

The edge shape and the cross-sectional area of the openings can be different in the various regions. Furthermore, it is also possible to provide different openings in one region. It is advantageous if a bottom region comprises openings with a diameter of 0.5 to 1.5 mm. A transition region can comprise openings with slots that are 0.05 to 0.2 mm wide. In particular for the removal of grinding elements from the pulper it is advantageous if, for example, an edge region comprises openings that are 2 to 8 mm in diameter.

In order to optimise the processes in the pulper it is proposed that the pulper, above the sheet, comprises grinding elements, preferably balls. Such grinding elements are added to the material to be pulped in order to increase the friction surface and to accelerate the pulping process, or in order to improve the quality of the pulped material.

In this arrangement it is advantageous if a region of the screening sheet comprises openings that are bigger than the grinding elements. If these openings lead to an open outflow, the grinding elements can be removed from the pulper by way of these openings.

In order to be able to operate the pulper at a continuous flow rate, it is proposed that the regions communicate, by way of openings, with various chambers, wherein the chambers in each case comprise at least one closable outlet. This makes it possible to utilise various screening regions of the pulper at various times, and by varying the opening width on the closable outlet, by way of special screening regions larger or smaller through-flows can be set, by way of which through-flows material leaves the pulper.

Within the pulper various types of circulation equipment and conveying equipment can be arranged. This conveying equipment also serves as an agitator or blade. It is advantageous if a helical screw is arranged within the pulper. Depending on its design, this helical screw can carry out conveying functions, cutting functions and/or circulating functions.

The pulper preferably comprises openings for adding the material to be treated, and for adding water or other liquids. It is advantageous if said pulper can be closed so as to be airtight. A cover that can be closed so that it is airtight makes it possible to build up pressure in the pulper.

Figure 2:
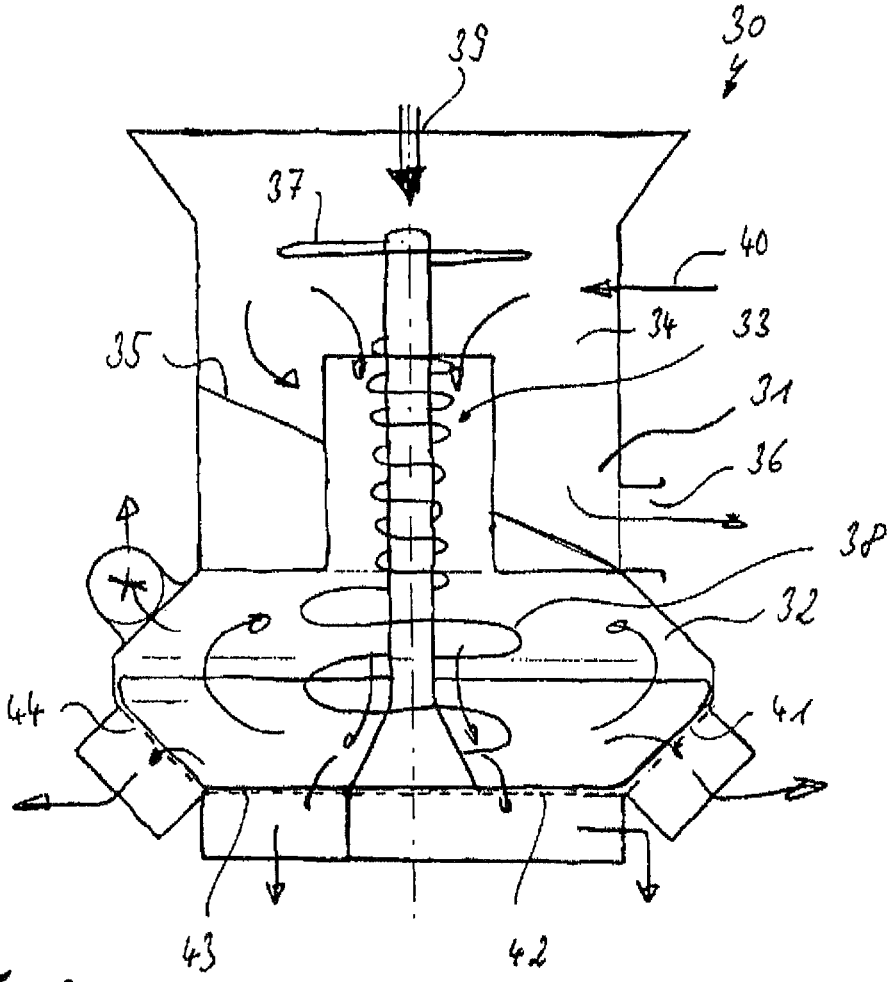
Figure 3:
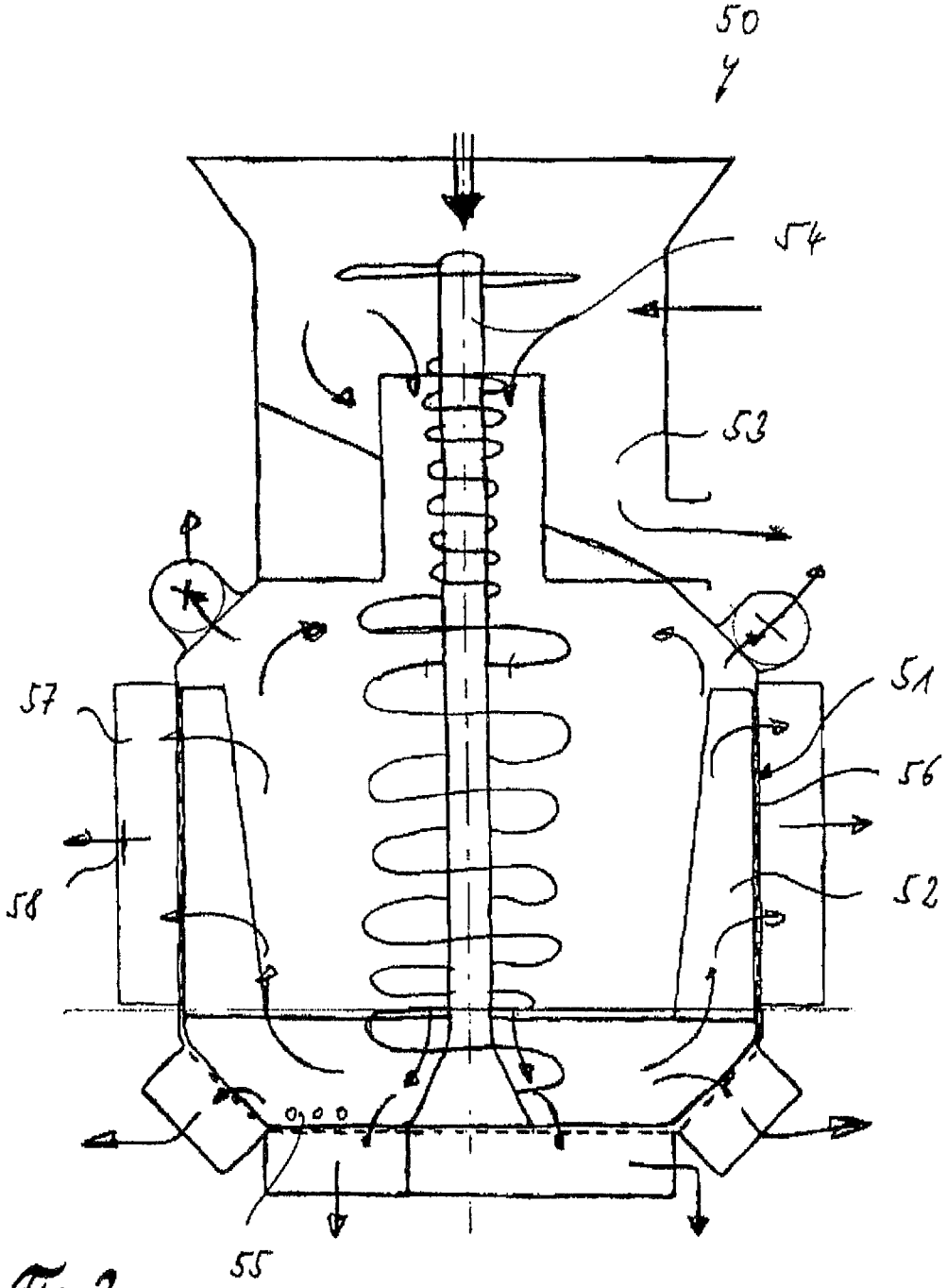

Three exemplary embodiments of the pulper according to the invention are shown in the drawing and are explained in detail below. The following are shown:

FIG. 1 a diagrammatic view of a pulper with an open-top mixing chamber,

FIG. 2 a diagrammatic view of a pulper according to FIG. 1 with a heavyweight contaminant catcher, and FIG. 3 a diagrammatic view of a pulper optimised for waste paper processing.

The pulper 1 shown in FIG. 1 is a continuous-operation high materials density pulper, which can also be designed as a displacement pulper or jacket-type pulper. This pulper comprises an open-top mixing chamber 2 in which the raw material, designated by arrow 3, is mixed with the water, designated by arrow 4. Thereafter the mixture reaches the displacement chamber with the screening sheets 6 to 9. As a result of these screening sheets the fibrous materials reach various regions 10 to 13 and finally the pure-materials outlets 14 to 17. The remnant material is discharged from the pulper by way of the remnant material outlet 18. The screening sheets 6 to 9 have different hole sizes or slot sizes.

The screen 19 comprising the screening sheets 6 to 9 thus has several screening sheets 6 to 9 that form various regions of the screen 19. These regions comprise openings of different sizes. In this design the bottom region 20 is arranged so as to be horizontal, and a transition region 21 is arranged so as to be inclined.

The bottom region comprises openings with a diameter of approximately 1 mm. The transition region comprises slots with a width of approximately 0.1 mm, and a length of approximately 20 mm.

Balls 22, whose shape and size are only implied in the figure, rest as grinding elements on the screen 19.

When the pulper is in use, the raw material is added to the pulper 1 as indicated by arrow 3 and in the mixing chamber 2 is mixed with the added water 4. The helical screw 23 on the one hand ensures circulation, and on the other hand conveyance to a displacement helical screw 24 which circulates the material with the grinding elements 22 above the screen 19. In this process, fibrous materials are conveyed, through the obliquely arranged screen regions, first into the chambers 10, 13. If these chambers comprise an open outlet 25, 26, the fibrous materials then flow from the pulper through the chamber into collection containers (not shown). If the outlets 25, 26 are closed and the outlets 27, 28 are open, material leaves the pulper only by way of these outlets 27, 28. Thus by means of the outlets 25 to 28 it is possible to control by way of which screen regions with what type of openings material is to leave the pulper.

The pulper 30 in FIG. 2 is designed according to the pulper 1 shown in FIG. 1. However, in addition said pulper 30 comprises a heavyweight contaminant catcher 31 that is arranged above the displacement chamber 32. This heavyweight contaminant catcher 31 is outside a central feeder helical screw 33. In this arrangement the central feeder helical screw 33 is arranged in such a manner that it generates sufficient radial forces for the heavyweight contaminants to reach the outer region of a supply chamber 34, where by means of a guide plate 35 they are guided to an outlet 36 of the heavyweight contaminant catcher 31. In this arrangement the heavyweight contaminant outlet 36 is situated above the displacement chamber 32.

The pulper 30 shown in FIG. 2 comprises a suspension disc 37, the supply screw 33 and a displacement screw 38 all on one axis. The coarse input materials 39 are mixed with the introduced water 40 and are suspended by means of the suspension disc 37. The suspension disc 37 can also be designed as a beater. Heavyweight contaminants are radially accelerated, guided by way of the guide plate 35, and removed from the pulper at the outlet 36. After this the material is circulated in the lower region of the pulper by means of the displacement screw 38. By way of various screening sheet regions 41 to 44, fine material is discharged in various regions from the pulper. By selecting different screen qualities it is also possible to discharge different materials qualities in the various regions 41 to 44.

The pulper 50 shown in FIG. 3 is designed as a waste paper pulper for continuous operation at high materials density with a relatively low specific pulping resistance. In this arrangement the waste paper is quickly suspended so that the free fibrous material needs to be discharged quickly in order to prevent blocking of the holes.

This is achieved by means of the screen cage 51, in which a high-drawn helical screw 52 ensures circulation and keeps the holes in the screen cage 51 free in that the attendant materials, paper chips and paper specks are swept by said helical screw 52 from the holes of the screen cage 51.

In the upper region of the pulper 50 a heavyweight contaminant discharge device 53 is provided so that waste paper can classically be supplied from the top. In this pulper the volume-related specific pulping performance is reduced and at the same time the volume-related specific hole area is greatly increased.

As is the case in the pulpers shown above, in the pulper 50, too, the centre axis 54 can be arranged in bearings at the top, at the bottom, or at the top and the bottom. This is relevant in particular in the case of a closed design, in particular comprising a mixing chamber and a heavyweight contaminant catcher.

Grinding elements 55 can be provided in all the pulpers, and the screen cage 51 can comprise a perpendicularly-arranged edge region 56, as shown in FIG. 3. For example, the perpendicularly-arranged edge region can comprise apertures of such a size that the grinding elements 55 can be removed through them from the pulper 50 by way of the chamber 57. If the chamber 57 is closed, grinding elements collect in it until said grinding elements are removed by means of opening the chamber outlet 58.

The invention claimed is:

1. A pulper comprising a screen having a bottom horizontal region and having outer regions surrounding the bottom horizontal region, the outer regions being disposed at least one of inclined to or perpendicular to the bottom horizontal region, wherein in the bottom horizontal region the screen comprises openings with a diameter of from 0.5 to 1.5 mm, wherein in the outer regions the screen comprises openings with a diameter of from 2 to 8 mm in diameter, wherein the openings form a connection between a displacement chamber and a plurality of additional chambers, and wherein each additional chamber of the plurality of additional chambers comprises at least one respective closable outlet and a respective closure device for closing the respective closable outlet.

2. The pulper according to claim 1, wherein the screen comprises multiple parts.

3. The pulper according to claim 1, wherein the outer regions of the screen comprise a transition region arranged so as to be inclined with respect to the bottom horizontal region.

4. The pulper according to claim 3, wherein the transition region comprises openings with slots that are 0.05 to 0.2 mm wide.

5. The pulper according to claim 1, wherein the outer regions of the screen comprise an edge region arranged so as to be perpendicular with respect to the bottom horizontal region.

6. The pulper according to claim 1, wherein the outer regions of the screen comprise a transition region arranged so as to be inclined with respect to the bottom horizontal region, wherein the outer regions of the screen further comprise an edge region arranged so as to be perpendicular with respect to the bottom horizontal region, and wherein the edge region, the transition region, and the bottom horizontal region are arranged so as to be concentric relative to each other.

7. The pulper according to claim 1, wherein the screen is designed as a cage.

8. The pulper according to claim 1, wherein the outer regions comprise an edge region having the openings that are 2 to 8 mm in diameter.

9. The pulper according to claim 1, wherein the pulper, above the screen, comprises grinding elements.

10. The pulper according to claim 9, wherein a region of the screen comprises openings that are bigger than the grinding elements.

11. The pulper according to claim 1, wherein a helical screw is arranged within the pulper.

12. The pulper according to claim 1, wherein the pulper can be closed so that the pulper is airtight.

* * * * *